US005145381A

United States Patent [19]

Volz

[11] Patent Number: 5,145,381

[45] Date of Patent: Sep. 8, 1992

[54] WEDGE DRIVEN ELASTOMERIC CONNECTOR

[75] Inventor: Keith L. Volz, Jamestown, N.C.

[73] Assignee: AMP Incorporated, Harrisburg, Pa.

[21] Appl. No.: 748,992

[22] Filed: Aug. 22, 1991

[51] Int. Cl.[5] ..... H01R 9/09

[52] U.S. Cl. ..... 439/62; 439/260

[58] Field of Search ..... 439/59, 62, 65, 73, 439/260, 86, 66, 91

[56] References Cited

U.S. PATENT DOCUMENTS 3,985,413 10/1976 Evans .
4,477,133 10/1984 Cosmo ..... 439/62
4,629,271 12/1986 Awano ..... 439/260

FOREIGN PATENT DOCUMENTS 0138368 4/1985 European Pat. Off. .
0256022 4/1988 Fed. Rep. of Germany .
0256023 4/1988 Fed. Rep. of Germany .

*Primary Examiner*—Neil Abrams
*Assistant Examiner*—Khiem Nguyen
*Attorney, Agent, or Firm*—William B. Noll

[57] ABSTRACT

An electrical connector (12) employs wedges (72) to drive elastomeric inserts (42) having conductive traces (52) against the conductive traces (64, 66) of a printed circuit board (60) with the connector housing (14) clamping the insert to a further printed circuit (68) and conductive traces (70) thereon to interconnect multiple conductive paths between the boards. The wedges include two latch positions through surfaces (80, 82) engaging spring latches (22) to allow board insertion and removal with low forces from the said connector.

7 Claims, 5 Drawing Sheets 76
72
84
86
74
80
78
84
60
80
64
82
62
10
18
30
18
12
22
28
16
24
22
32
14
42
26
16
15
20

WEDGE DRIVEN ELASTOMERIC CONNECTOR

This invention relates to an electrical connector for interconnecting printed circuit boards or the like utilizing a wedge to drive an elastomeric insert having conductive traces against at least one of the boards.

BACKGROUND OF THE INVENTION

In U.S. Pat. No. 3,985,413, granted Oct. 12, 1976, a type of elastomeric connector is disclosed which includes a core of elastomeric, flexible and resilient material around which is wrapped a thin insulating film containing multiple conductive traces. The film may be bonded to the core to provide a means to interconnect the traces of circuit boards. Connectors made in this manner are used to provide interconnections between printed circuit boards and the like, or in some cases printed circuit boards and flexible circuits wherein the traces are on very close centers. The connector utilizing this technique has the advantage of having the trace rendered by essentially the same process that traces are rendered on rigid and flexible printed circuit devices.

The invention represents an improvement utilizing conductive elastomeric connectors which connect circuit traces of printed circuit boards and the like and has as an object the provision of a high density electrical connector which is simple in manufacture and use. A further object is to provide an electrical connector for interconnecting circuit traces on close centers with few parts that can be assembled to provide essentially a one piece assembly for handling and use. A further object is to provide a connector which can be activated between two positions, one allowing an insertion or withdrawal of a daughter card relative to a mother board and the other latching the connector in a manner to effect an electrical interconnection of the traces on mother and daughterboards.

SUMMARY OF THE INVENTION

The present invention achieves the foregoing objectives by utilizing a connector housing adapted to be mounted on a back panel or mother board and clamped thereto, such housing containing an interior opening of a shape to include slots at the ends to receive and guide a daughter board inserted therein and sloped surfaces leading from the opening. The housing opening further includes an interior space adapted to receive inserts which extend across the length of the housing and are comprised of an elastomeric, flexible and resilient, insulating core around which is wrapped a thin film containing conductive traces. These traces are preferably produced by the same processes utilized to produce flexible and rigid circuit boards so that the traces can be placed on centers having a very fine pitch. The inserts are L shaped in cross section to include a foot portion which is caused to bear against the circuit traces on a mother board by being clamped there against through the clamping of the housing to such mother board. The inserts further include interior conductive traces which are driven against the circuit traces of the daughter board by wedges which are driven downly into the opening of the housing having the sloped interior walls. The wedges include on the ends thereof surfaces which latch with spring driven surfaces integral with the housing at the ends thereof facing interiorly of the housing outer dimensions. The latching surfaces are arranged so that the wedges can be latched in an upward condition allowing an easy and almost zero insertion force of the daughter board into the connector and a second and downward position wherein the latches of the housing engage the top corner surfaces of the wedges to hold them in position compressing the elastomeric inserts effecting an electrical interconnection between the circuit traces on the daughter board and the circuit traces on the mother board.

DETAILED DESCRIPTION OF THE PREFERRED EMBODIMENT

Figure 1:
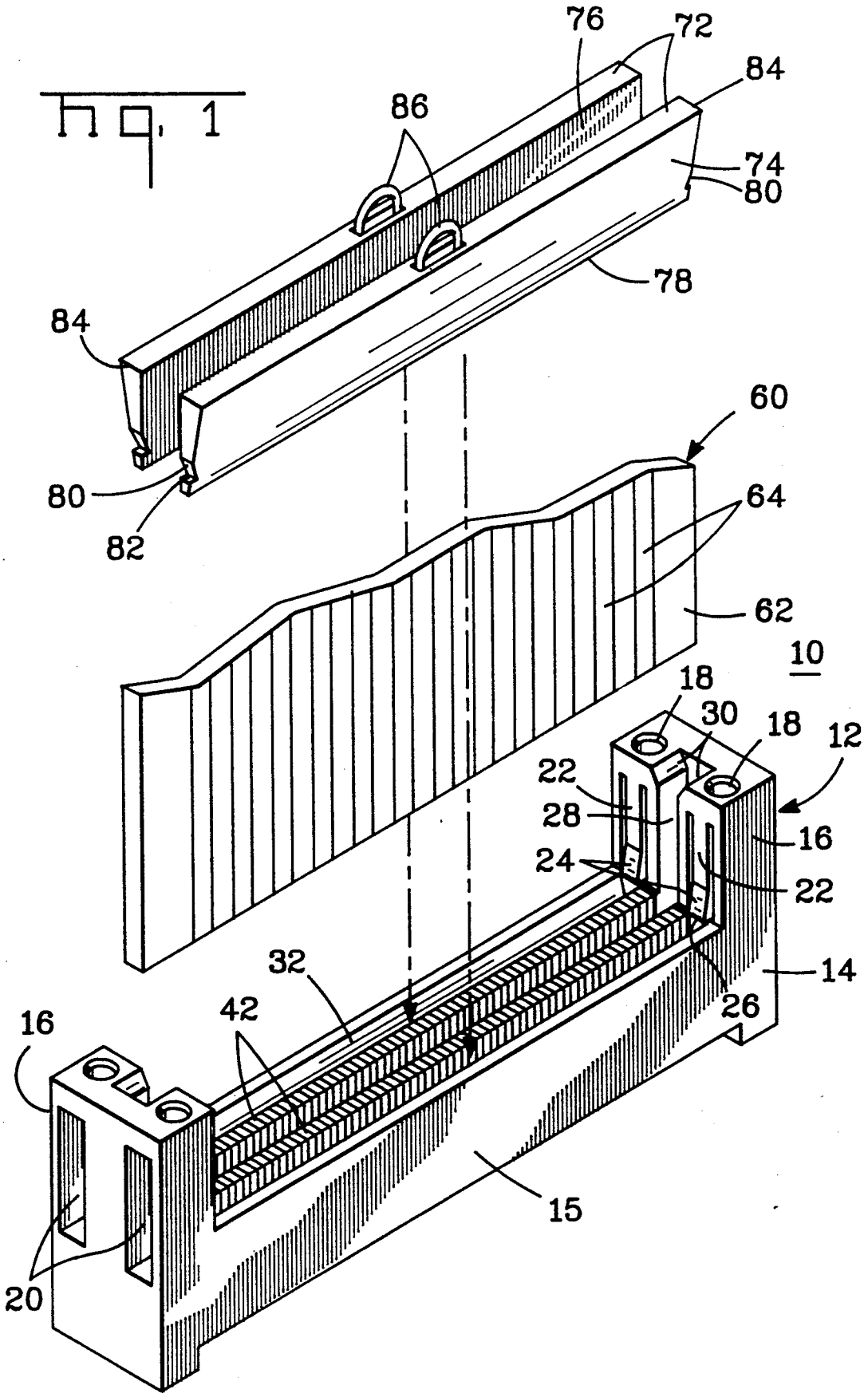
FIG. 1 is a perspective showing the connector of the invention in relation to a daughter board and wedges, exploded from such connector.
Figure 2:
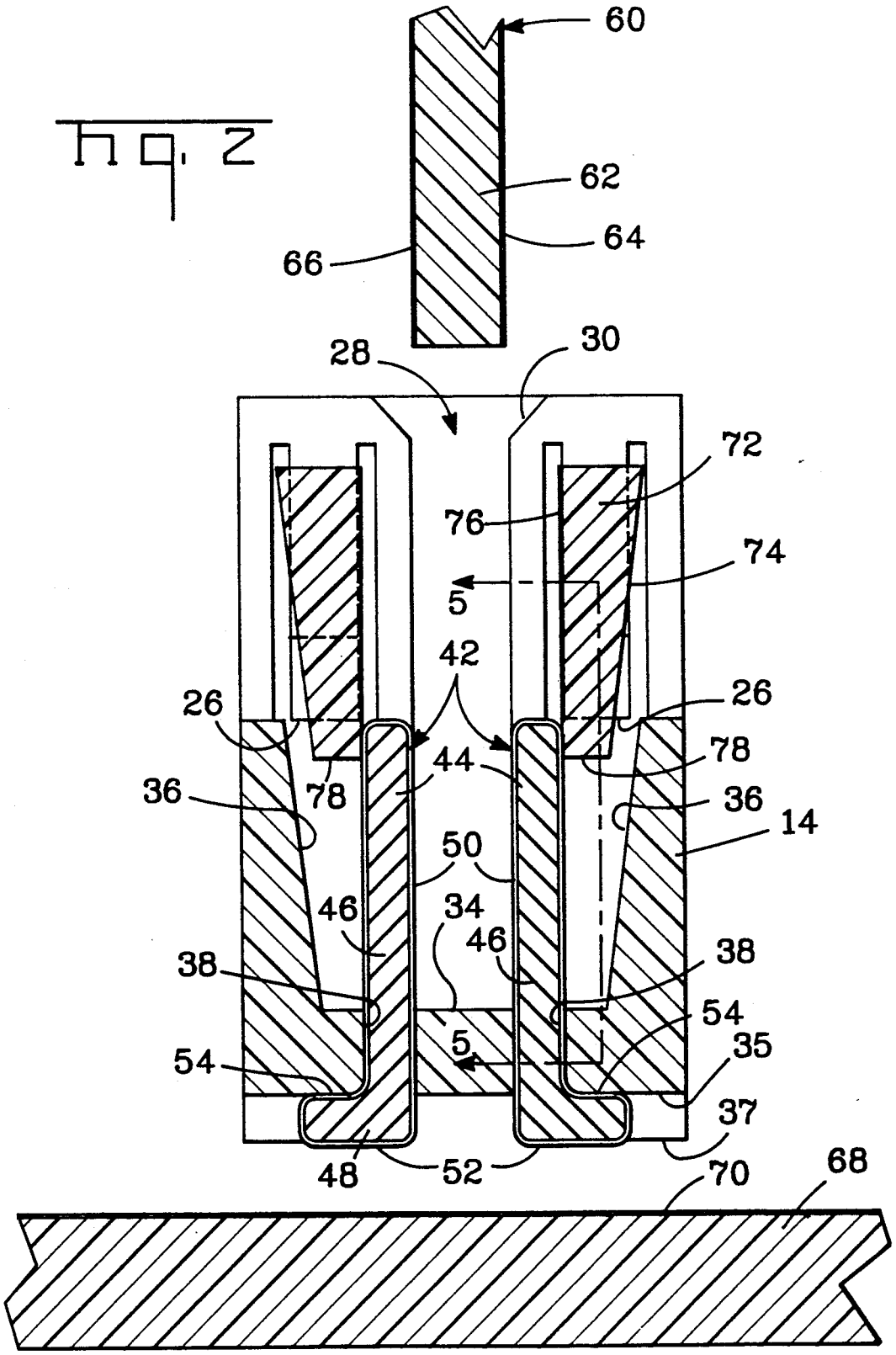
FIG. 2 is a side, elevational and partially sectioned view showing the disposition of a daughter board, and mother board and the connector of the invention.
Figure 3:
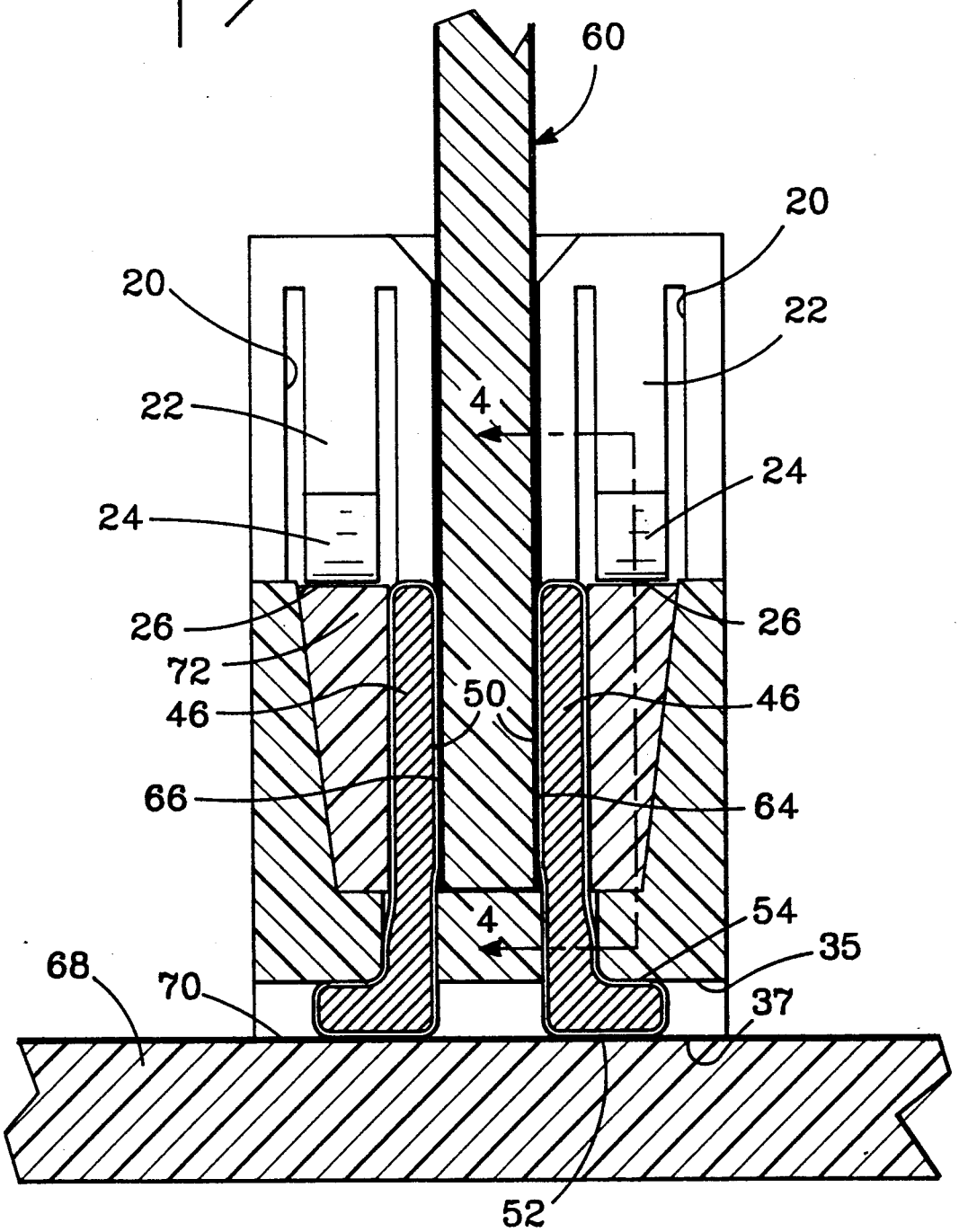
FIG. 3 is a view of the elements shown in FIG. 2, as assembled with the daughter board inserted and seated and the connector clamped to the mother board with wedges activated.

According to FIG. 1 an assembly 10 is shown to include an electrical connector 12 in relation to a printed circuit board 60 which may be thought of as a daughter card or board and a pair of wedges 72. The connector 12 would in practice be mounted upon a back panel or mother board 68, as shown in FIGS. 2 and 3 electrically and mechanically connecting the board 60 to the board 68 to interconnect circuit traces on the boards to each other so as to interconnect components, not shown, carried on the daughter board to circuit traces on the mother board or contained in laminations therein. Such circuit traces on board 60 are shown in FIG. 2 as 64 and 66 and the upper circuit trace on board 68 is shown as 70. It is to be understood that vias in board 68, not shown, can be utilized to interconnect the surface traces 70 to traces within board 68. The overall interconnection served by the forgoing is intended to provide functional electronic devices such as computers, communication equipment and the like.

Figure 4:
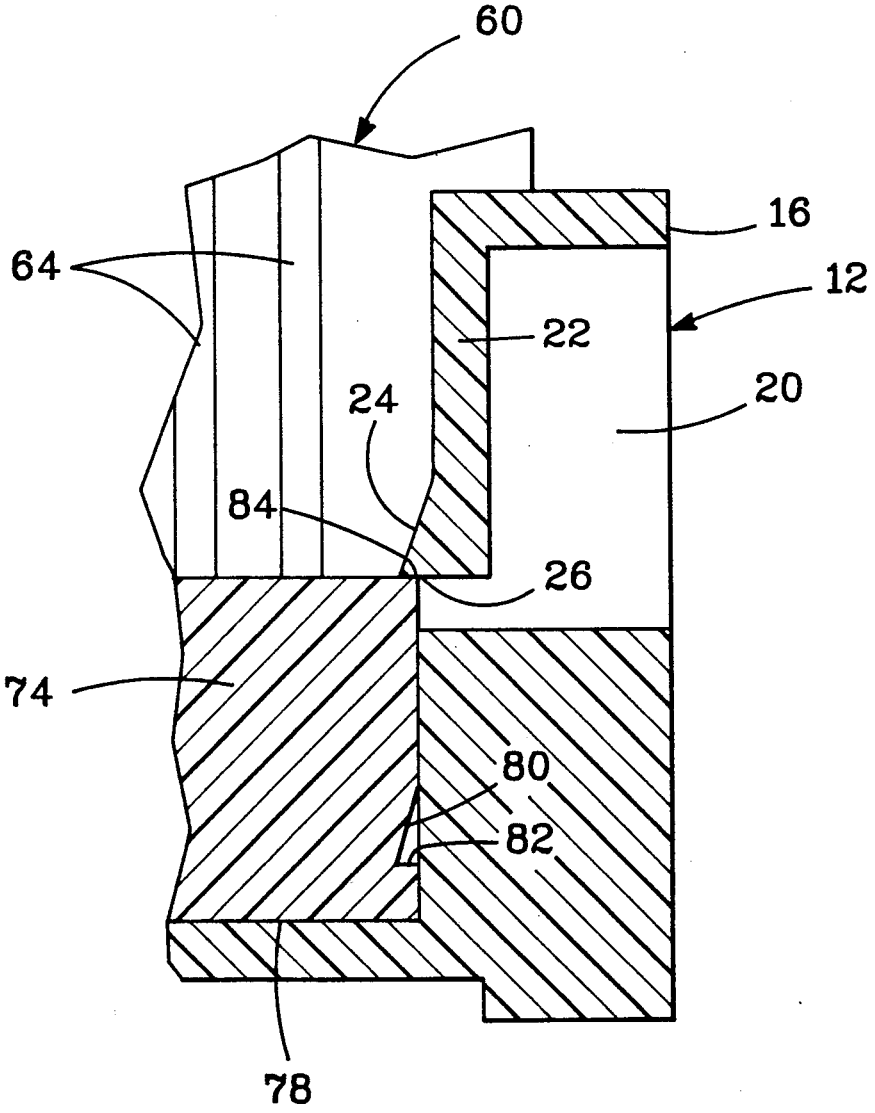
FIG. 4 is a front, end, partially sectioned elevational view of the connector of the invention depicting a wedge in a condition of activation latched within the housing of the connector.

Referring back to FIG. 1 it will be apparent that the connector 12 has a housing 14 which is typically formed of an engineering plastic as by molding. The housing 14 includes a base 15 with upstanding portions 16 at each end and also at each end pairs of holes 18 which extend through cavities 20 and down into the base portion 15 to allow fasteners to clamp housing 14 to the printed circuit board. These fasteners are not shown but would be screws or bolts or the like passed through apertures in the mother board 68 to hold and clamp housing 14 down against the board. As can be seen in FIG. 1, at the ends, portions 16 contain latch elements formed integrally with the housing material, the elements being shown as 22 to include at the lower and free end thereof sloped surfaces 24 and edge end surfaces 26, these details being better shown in FIGS. 4 and 5. The housing 14 includes in the projections 16 end slots 28 which act as card guides. These slots are beveled as at 30 to facilitate entry of and insertion of the daughter board 60, with the slots 28 serving to align and position the board 60 precisely relative to the traces thereon. Housing 14 includes interiorly an open space 32 which extends along the length thereof.

The housing further includes a bottom surface 35 as can be seen in FIG. 2 and a further bottom surface 37 spaced therefrom. Within the interior of housing 14 is floor surface 34 as shown in FIG. 2 extending along the length of the housing and adjoining such surface are vertical interior sloped surfaces 36 also as shown in FIG. 2. Slots 38 extend through the surface 34 and through the bottom of the housing to join first surface 35 which extends across the width of the connector and along its length. A pair of inserts 42 are fitted through the apertures 38 in the manner shown in FIG. 2 and as can be seen these inserts are L shaped in cross section and extend in the manner shown in FIG. 1 across the length of the connector. The inserts 42 each are comprised of an L shaped core 44 which includes an upstanding portion 46 and a foot portion 48. The core is comprised of an elastomeric, insulating material such as silicone rubber or materials having similar dielectric and resilient characteristics. The cores shown in the Figures each include a thin film circuit 50 wrapped there around and bonded or joined thereto. The circuits 50 include conductive traces 52 thereon. The traces 52 preferably extend to the bottom of the feet 48 and interiorly proximate to the insertion axis of printed circuit board 60. The traces may extend around the cores or be limited to those areas where contact is necessary. In any event, the traces interconnect the areas interiorly of the cores to the areas on the feet of the cores. Traces 52 are placed on centers having a pitch either equal to the pitch of traces on the boards or a fraction thereof to provide a redundancy of contact and interconnection between the traces of mother and daughter boards. FIG. 3 shows the connector 14 in a position, clamped to board 68 the surface 37 limiting the compression of the elastomeric core 44 in the foot 48 thereof. This can be discerned in FIG. 3 wherein the surface shown as 54 is compressively driven by surface 35, surface 37 limiting compression. As can be appreciated the conductive traces 52 are driven by the core material against the conductive traces 70 of board 68 to provide an interconnection thereto.

Referring back to FIG. 1 and also to FIG. 2 the connector assembly includes a pair of wedges 72 which are molded of an engineering plastic to include a body having exterior surface 74 exteriorly disposed and sloped relative to interior surfaces 36 of housing 14. The wedges have a bottom surface 78 as shown in FIGS. 1, 2 and 4 and 5. At the ends of each wedge are further surfaces 80 and 82, surface 80 being beveled in the manner shown in FIG. 4 leading to further surface 82 which is horizontal relative to the wedge height. Additionally each wedge includes at the end a corner surface 84.

FIG. 2 shows the wedges latched in a position to allow insertion of a board 60 into the connector housing 14, and withdrawal from such housing. At such time the wedges are in an upwardly displaced position, latched upwardly in the manner shown in FIG. 5 with the surfaces 80 and 82 functioning to hold the wedges against the ends 26 of the latches 22. The inserts 42 are relatively uncompressed in the upper legs 46 and therefore insertion or withdrawal of board 60 occurs with a low insertion force, and as well, a low withdrawal force. Once board 60 is inserted in the connector 12 the wedges 72 are driven downwardly from the position shown in FIGS. 2 and 5 to the position shown in FIGS. 3 and 4. As can be appreciated the elastomeric cores of the inserts are compressed driving the traces 52 against the traces 64 and 66 of board 60 to effectively interconnect such traces and thereby interconnect to the traces 70 on board 68. In driving the wedges downwardly from the position of FIG. 5 the beveled surface 24 cooperates with the beveled surface 80 to facilitate a easy deflection of latches 22 until the end 26 of the latches engages the horizontal surface edge of the corners 84 at which time the latches spring outwardly shown to the position shown in FIG. 4 latching the wedge in place.

Figure 5:
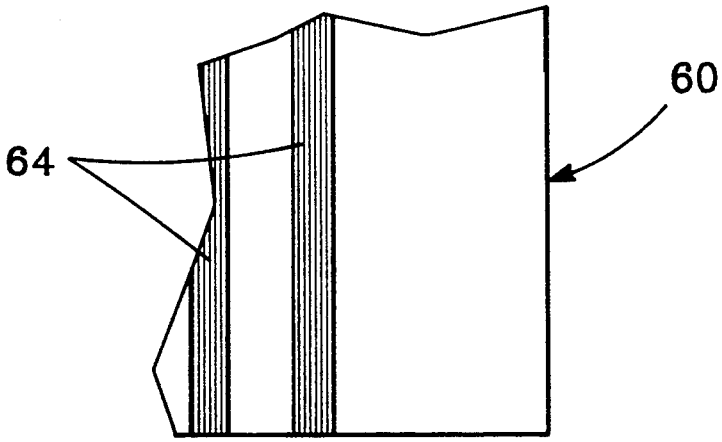
FIG. 5 is a view of the end of the connector shown in FIG. 4 with the wedge in an unactivated and latched position employed prior to insertion of the daughter board thereshown.
Figure 5:
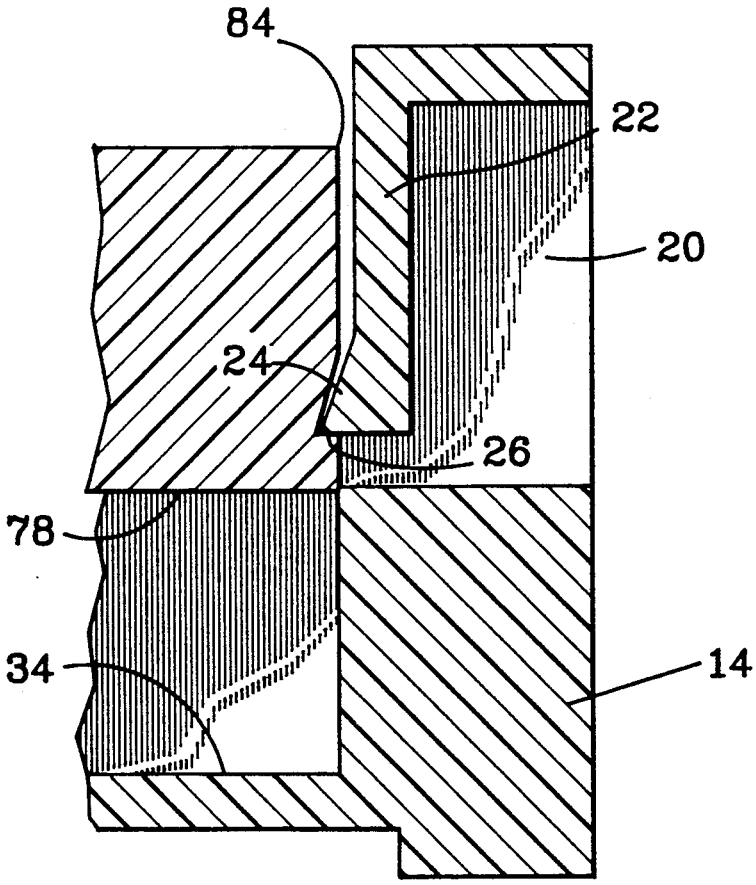

In order to remove board 60 the latches 22 at one end of the connector are deflected outwardly as by an operator with the wedges drawn upwardly at that end and then the latches 22 at the opposite end deflected outwardly and the wedges fully displaced upwardly to the position shown in FIG. 5 wherein the wedges latch in an open position. Integrally molded tabs 86 as shown in FIGS. 1 and 2 and 3 may be included to facilitate drawing the wedges upwardly when the latches 22 are deflected outwardly. To be appreciated is the fact that the connector of the invention is essentially a one piece device in terms of handling inventory and use, the inserts 42 remaining with the housing 14 and the latches as well, latched in the position as shown in FIGS. 2 and 5.

The invention shows L cross section sheets for the inserts 42. Inserts of other cross sectional configurations including cores extruded or molded are contemplated. In addition to a variety of different cross sectional shapes for the elastomeric cores 46, it is contemplated that circuits 50 may be discontinuous along the length to provide a variety of different circuit paths. For example, every other circuit trace 52 might be made to end at a different position on the vertical portions 46 of cores 44 and on the horizontal portions of the feet 48 to thus pick up conductive traces staggered on the mother and daughter boards.

I claim:

1. An electrical connector for interconnecting the conductive traces of printed circuit boards or the like including a plastic housing having an opening adapted to receive and guide a first circuit board inserted therein and means to clamp the said housing to a second board, at least one insert comprised of an elastomeric insulating material having conductive traces therein and fitted in said opening, the said insert including a side aligned with and proximate to the surface of the said first board as inserted in said housing and a second side positioned to engage the second board and be compressed by said housing as clamped to said second board, wedge means having a cross section to fit into said opening proximate to said insert and engaging the inner walls of said housing so as to wedgingly compress the said insert as said wedge means is driven in said housing, first means to hold said wedge means in said housing in a first position to provide an interconnection of the traces of the said boards and second means to hold the said wedge means in a second position in said housing to facilitate a low force insertion and withdraw of said first board relative to said housing.

2. The connector according to claim 1 wherein said first means is defined by surfaces interior of said housing and surfaces on the said wedge means operable to latch said wedge means in said first position in said housing affecting the compression of said insert.

3. The connector according to claim 1 including a pair of inserts operable to engage the opposite sides of the said first board and interconnect the traces thereon to rows of traces on said second board.

4. The connector according to claim 1 wherein the said insert is L shaped in cross sectional geometry.

5. The connector according to claim 1 wherein the said insert includes an elastomeric material covered with a thin insulating film having conductive traces thereon, defining a multiplicity of conductive paths.

6. The connector according to claim 1 wherein the said means to hold said wedge means in said housing includes latch surfaces operable to engage said wedge means and further includes a deflectable element to release said wedge for displacement in said housing.

7. The connector according to claim 1 wherein said first and second means comprise surfaces interiorly of said housing and at the ends of said wedge means.

* * * * *